United States Patent [19]

Jacobsmeyer et al.

[11] 4,454,947

[45] Jun. 19, 1984

[54] PRODUCT INSPECTION AND EJECTION SYSTEM

[75] Inventors: Bernard J. Jacobsmeyer, St. Louis, Mo.; Gary D. Reding, Godfrey, Ill.

[73] Assignee: Olin Corporation, Stamford, Conn.

[21] Appl. No.: 327,866

[22] Filed: Dec. 7, 1981

[51] Int. Cl.[3] ..... B07C 5/04

[52] U.S. Cl. ..... 209/548; 73/167; 209/555; 209/564; 209/604; 209/925; 209/936

[58] Field of Search ..... 209/509, 539, 546, 548, 209/552, 555, 556, 563, 564, 567, 571, 576, 577, 578, 586, 600, 601, 604, 644, 916, 925, 936; 73/167; 86/1, 32, 33

[56] References Cited

U.S. PATENT DOCUMENTS

| | | | |
|---|---|---|---|
| 2,393,246 | 1/1946 | Hallowell, Jr. | 73/167 |
| 2,715,962 | 8/1955 | Messinger | 209/552 |
| 2,781,126 | 2/1957 | Wood | 209/600 |
| 2,859,871 | 11/1958 | Harlow et al. | 209/571 |
| 3,422,542 | 1/1969 | Spurr | 209/936 X |
| 3,680,966 | 8/1972 | Cofek et al. | 73/167 X |
| 3,712,466 | 1/1973 | Aubry et al. | 209/936 X |
| 3,736,793 | 6/1973 | Christensen | 73/167 X |
| 3,863,349 | 2/1975 | Wilson | 209/601 X |
| 3,969,228 | 7/1976 | Browning | 209/936 X |

FOREIGN PATENT DOCUMENTS

| | | | |
|---|---|---|---|
| 0079385 | 12/1919 | Fed. Rep. of Germany | 73/167 |
| 0011669 | of 1909 | United Kingdom | 209/604 |

*Primary Examiner*—Robert B. Reeves
*Assistant Examiner*—Edward M. Wacyra
*Attorney, Agent, or Firm*—Bruce E. Burdick

[57] ABSTRACT

A method of removing product of an unacceptable height from a product line is disclosed. In the method, a quantity of the product is arrayed in a carrier and moved to a gauging station where the array is placed between a reference plate and a corresponding array of gauging members and gauged by raising the reference plate to a predetermined height position and measuring the height of the gauging members when the gauging members are supported on the product array. The signals from the gauging station are stored and the carrier plate is moved to a rejection station where unacceptable product is selectively removed in response to the stored rejection signals from the gauging station. The carrier plate is then returned to the product line with only acceptable product still in place.

10 Claims, 7 Drawing Figures

PRODUCT INSPECTION AND EJECTION SYSTEM

BACKGROUND AND SUMMARY OF INVENTION

This invention relates to product inspection methods, and particularly to methods for inspecting product and automatically removing unacceptable product from a production line.

There is a continuing need for better methods of removing unacceptable product from production lines. The current emphasis on product quality in all manufacturing fields is strong. One field where product quality is critical is that of primers for ammunition, since misfires in dangerous situations such as police use, combat or certain types of hunting can literally cost one his or her life. In the past there has been visual inspection of primers to determine acceptable quality. However, primers are produced in such enormous quantities that visual inspection is unreliable.

The present invention solves this unreliability of existing primer production methods by rapidly and automatically removing unacceptable primers from a primer production assembly line. The method is applicable to other products by routine mechanical modifications. In particular, the present invention provides:

1. A method of removing product of an unacceptable height from an array of product in a production line, which comprises the steps of:

(a) supporting a quantity of said product in a product carrier in an array of rows and columns;
(b) moving said carrier to a gauging station;
(c) placing said array between a planar plate and an array of gauging members of known height;
(d) uniformly raising said reference plate, relative to said carrier plate and gauging members, to a predetermined height position so as to cause said reference plate to support said product array and said product array in turn to support said array of gauging members;
(e) measuring the height of each gauging member in said array of supported gauging members;
(f) generating a first rejection signal corresponding to each gauge member whose height is not within a predetermined range;
(g) storing all of said first rejection signals;
(h) lowering said reference plate so that said assemblies are again supported by said carrier plate;
(i) moving said carrier plate to a rejection station;
(j) selectively activating a product removal device in response to said first rejection signals so as to automatically remove from said carrier plate only those products corresponding to gauging members which had an unacceptable height during said measuring; and
(k) returning said carrier plate to said production line.

The invention can be better understood by referring to the attached drawing in which.

DETAILED DESCRIPTION

Figure 1:
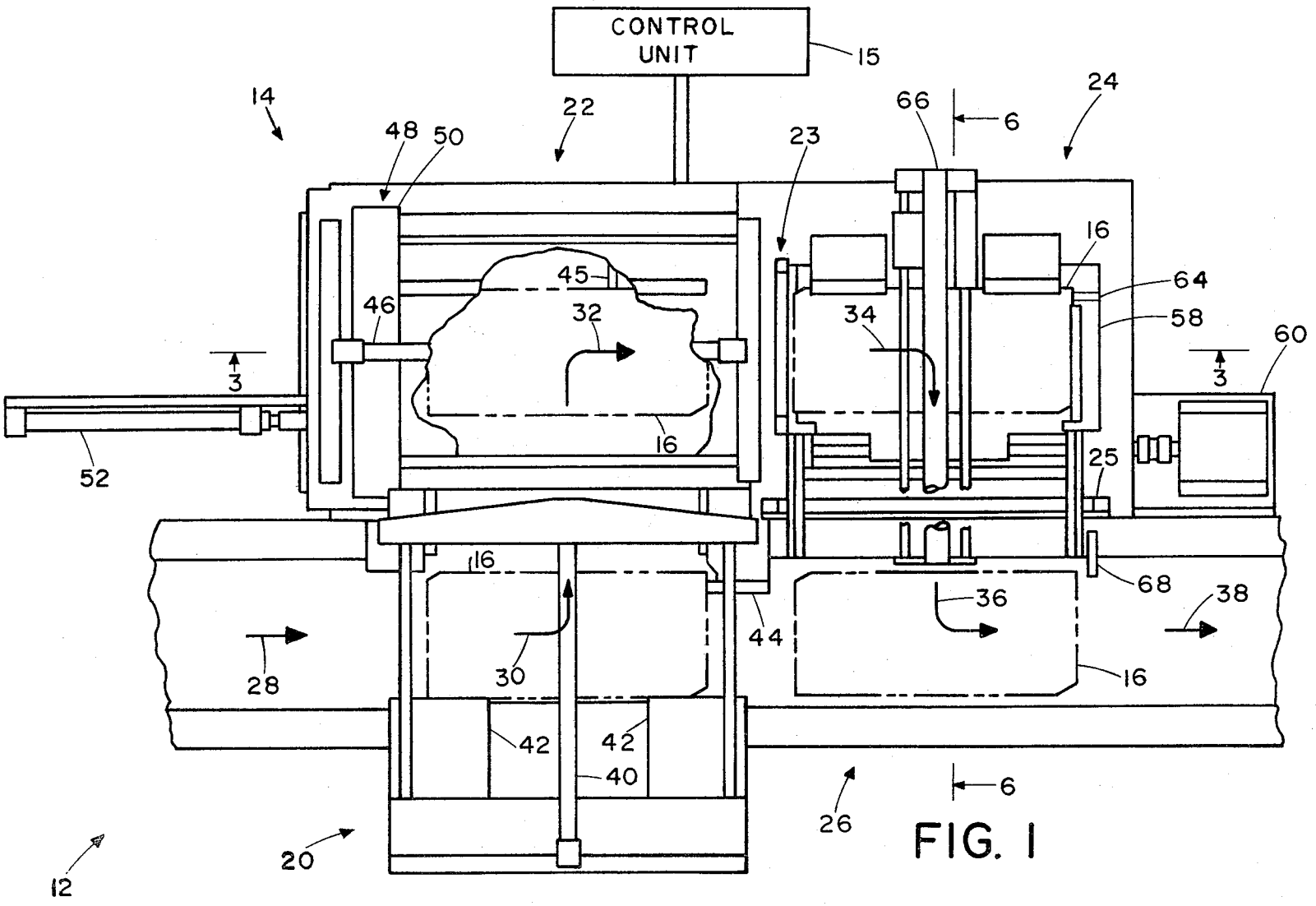
FIG. 1 is a top plan view of an inspection system which utilizes the method of the invention.

Referring to FIG. 1, a portion of a primer production line 12 and an inspection system 14 are shown. Inspection station 14 serves to locate and remove unacceptable primers from the production line 12. Primers are arrayed in carrier plates 16. For example, 960 primers can be arrayed in 48 rows of 20 primers each. Production line 12 includes a horizontal conveyor 18 which moves plates 16 (shown in phantom lines) to and from inspection system 14 before and after inspection. Inspection system 14 comprises a control unit 15 and six basic stations, a receiving station 20, a gauging station 22, a photoelectric check station 23, an ejection station 24, a verification station 25 and an exit station 26.

Control unit 15 is a microprocessor unit capable of real-time processing of information. Control unit 15 receives signals from system 14 and determines whether or not the signals indicate acceptable or unacceptable product and memorizes the position of any unacceptable product in the array and directs ejection station 24 so that only the unacceptable product is ejected. The flow through the inspection system 14 is shown by arrows 28, 30, 32, 34, 36 and 38. It will be noticed that the normal flow along production line 12 is from left to right as shown by arrows 28 and 38.

Receiving station 20 includes a push mechanism 40, two pusher channels 42 and a first activation sensor 44. Carrier plate 16 initially moves along conveyor 18 into channels 42 until plate 16 activates activation sensor 44. Sensor 44 can preferably be a conventional proximity switch which activates when plate 16 reaches the desired position. Push mechanism 40 is then activated to move channels 42 and hence plate 16 from receiving station 20 into gauging station 22.

Gauging station 22 includes a second activation sensor 45, a second transfer mechanism 52 and a gauging mechanism 48. When plate 16 moves from receiving station 20 into gauging station 22, plate 16 activates activation sensor 45 when plate 16 reaches a position where the array of primers are aligned with arrays of gauging pins (see FIG. 4). Push mechanism 40 returns to its original position leaving plate 16 in position in gauging station 22. Then gauging mechanism 48, which includes a sensor bar 50 and a sensor mover 46, is activated to detect and memorize the position of any unacceptable height product held by carrier plate 16. The detection is done by sensor mover 46 moving sensor bar 50 from left to right over plate 16 to measure each of the primers carried by carrier plate 16 and generate a signal corresponding to each measurement. This signal is transmitted to the control unit 15 which determines if the product height is acceptable or not. Upon completion of this measurement, transfer mechanism 52 is activated to move plate 16 to ejection station 24.

During passage of plate 16 from gauging station 22 to ejection station 24 plate 16 passes through a photoelectric check station 23. At check station 23 a light beam is passed through openings in plate 16 to determine if a certain primer component is present or not. Ejection station 24 comprises an incline frame 58, a pivot mechanism 60, an ejection device 62 (see FIG. 6), an activation switch 64 and a third transfer mechanism 66. When plate 16 moves into position in ejection station 24, plate 16 activates activation switch 64 thereby causing second transfer mechanism 52 to return to gauging station 22, leaving plate 16 at ejection station 24. After the return of transfer mechanism 52, pivot mechanism 60 is activated to pivot the incline frame 58 downward to an inclined position from which unacceptable primers can be ejected without falling back into plate 16. While plate 16 is in this downward inclined position ejection device 62 is selectively activated to eject all unacceptable product from plate 16. Upon the completion of the ejection of unacceptable product, ejection device 62 is returned to its initial position and pivot mechanism 60 is reactivated to lift incline frame 58 back to its original horizontal position and third transfer mechanism 66 is then activated to push plate 16 from ejection station 24 into exit station 26. Between ejection station 24 and exit station 26 lies a verification station 25 which serves to detect by photoelectric means whether or not any unacceptable product has failed to be ejected. This is accomplished by passing a light beam through the openings in plate 16 and checking to see if product is present, i.e. the beam is broken, at any of the product positions which were found to be unacceptable at either gauging station 22 or photoelectric check station 23. If any unacceptable product is still found to be present, a restraint 68 is activated to prevent plate 16 from proceeding along conveyor 18.

Figure 2:
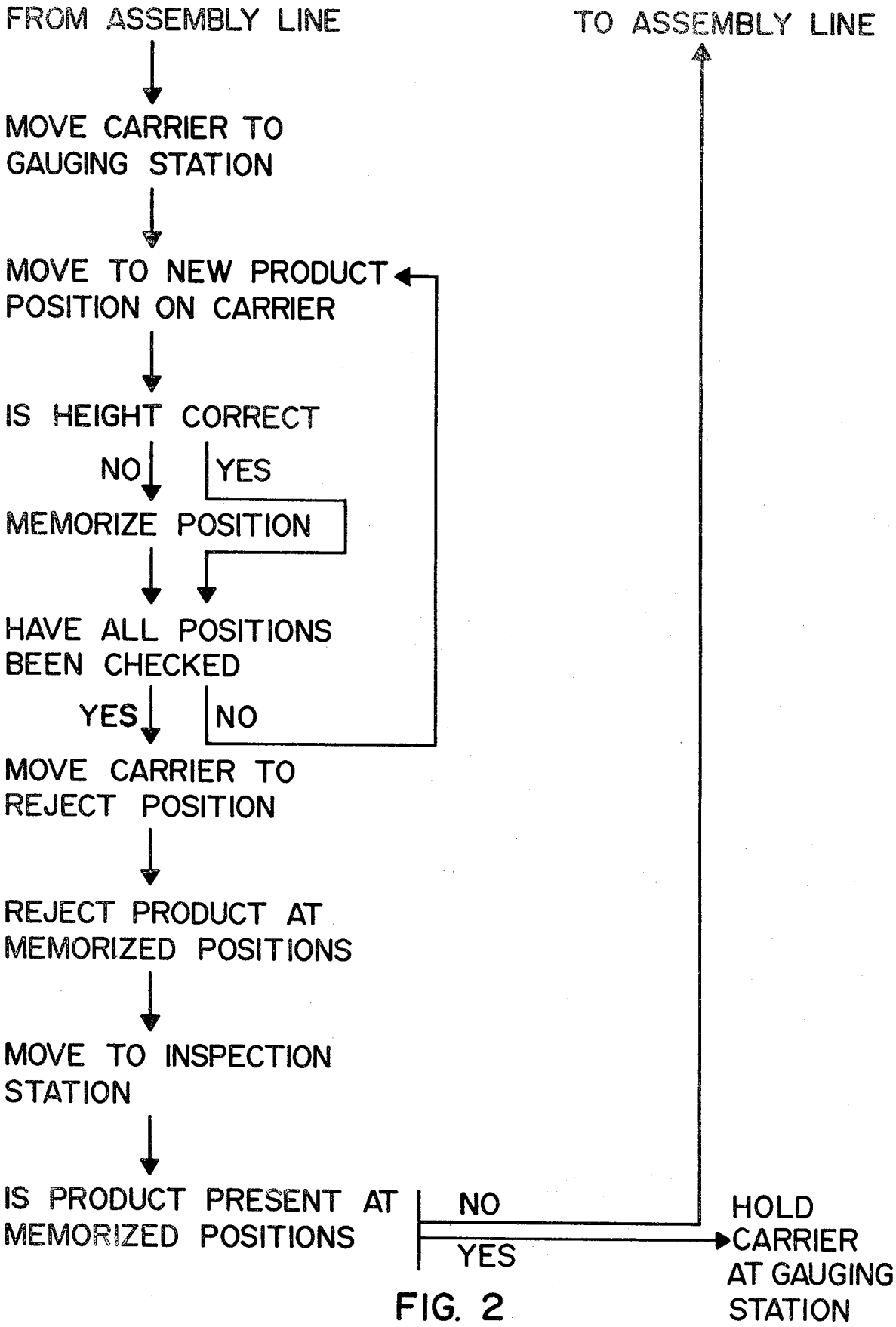
FIG. 2 is a flow chart to clarify the sequence of events as product flows through the system of FIG. 1.

FIG. 2 shows the flow through inspection system 14 in graphic form as a flow chart. It is seen that the carrier plate moves from the assembly line to a gauging station and that a detector is moved to a new product position on the carrier and a determination is made whether or not the height of the product is correct. The product position is memorized if the height is found to be incorrect and is not memorized if product height is correct. The detector is sequentially moved through each of the product positions until all product positions have been checked and all incorrect height positions memorized. The carrier is then moved to a reject position at which product is rejected (i.e. ejected) at the memorized positions. The carrier is then moved to an inspection or exit station at which a determination is made whether or not product is still present at the memorized positions. If product is still present at the memorized positions, the carrier is prevented from returning to the assembly line. If no product is present at the memorized positions, the carrier plate is allowed to return to assembly line for further processing.

Figure 3:
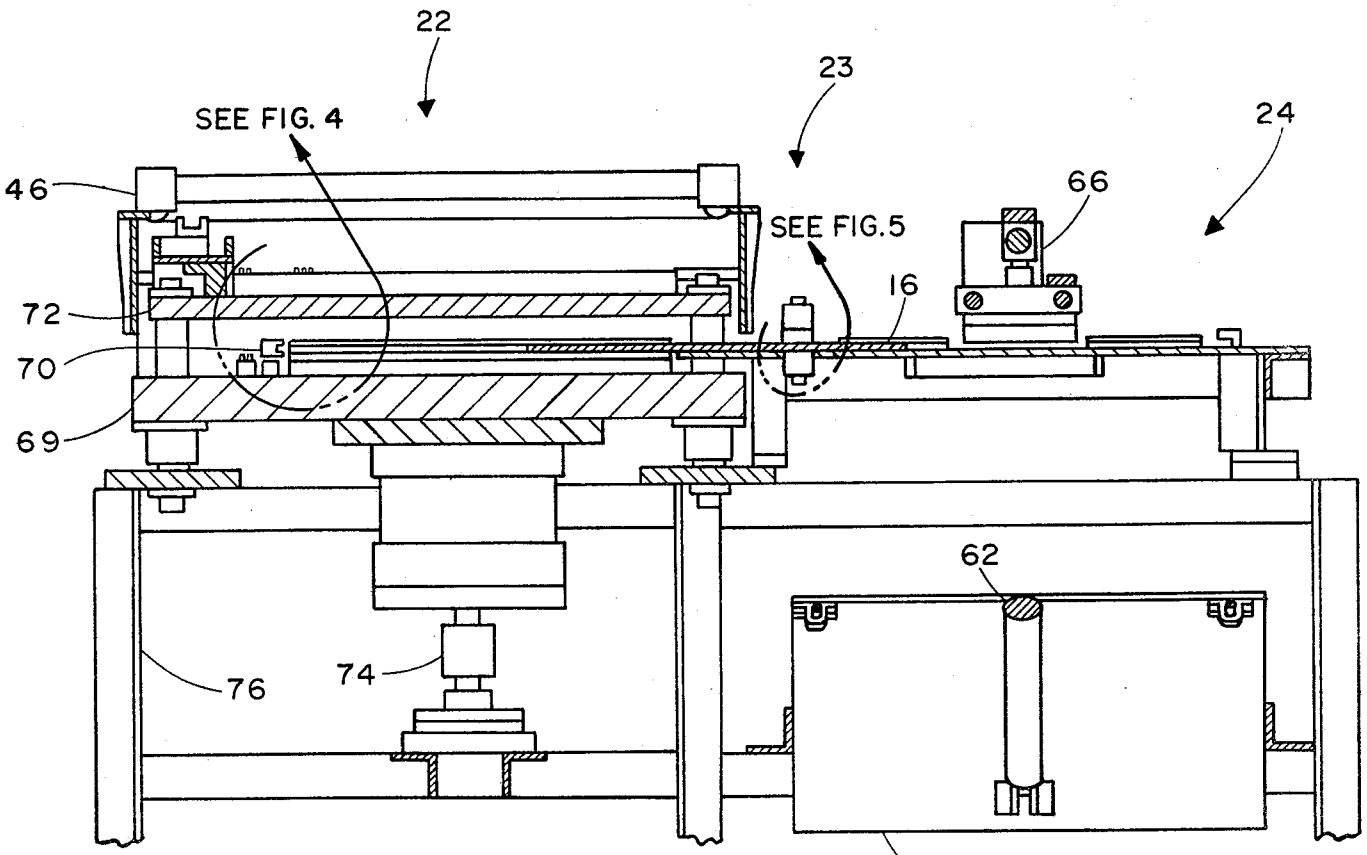
FIG. 3 is a vertical cross-sectional view taken along lines 3—3 of FIG. 1.

Referring now to FIG. 3 which is a vertical, cross-sectional view taken along lines 3—3 of FIG. 1, the relationship of gauging station 22, photoelectric check station 23, and ejection station 24 is seen. Gauging station 22 is seen to comprise a reference plate support member 69, a carrier support channel 70, a pin holder frame 72, a sensor mover 46, and a lifting mechanism 74. Lifting mechanism 74 is attached to the bottom of reference plate 69 and serves to lift reference plate 69 against plate 16 when plate 16 is at gauging station 22. Reference plate 69 is a high tolerance piece which is substantially horizontal and is calibrated by means described below so that reference plate 69 uniformly lifts the individual primers upwardly out of carrier plate 16 so that they can be gauged by the pins held by pin holder frame 72. An expanded view of the relationship of the carrier plate 16 with gauging station 22 during the gauging operation is shown in FIG. 4 which will be described below.

Figure 5:
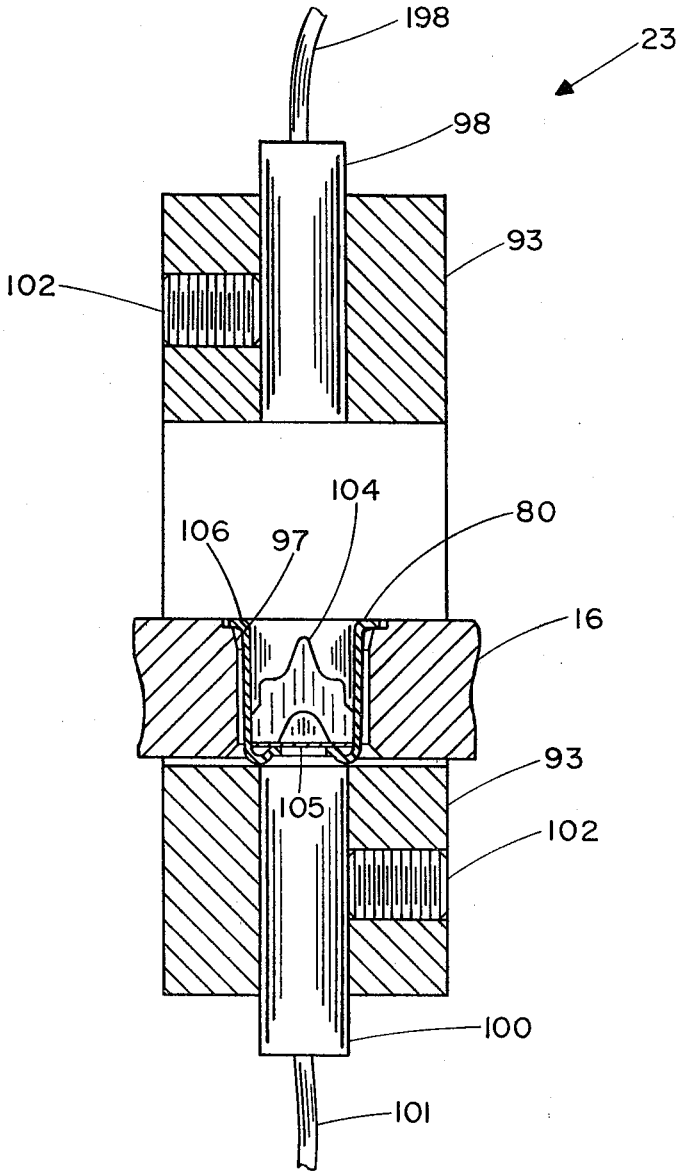
FIG. 5 is an enlarged view of the optical inspection station of FIG. 1.

Still referring to FIG. 3, photoelectric check station 23 is seen to lie between gauging station 22 and ejection station 24 so that plate 16 must pass through photoelectric check station 23 during its movement from gauging station 22 to ejection station 24. As plate 16 moves through photoelectric check station 23, a light beam is passed through the openings in carrier plate 16 to check for the presence of a particular primer component known as a foil. The relationship of plate 16 to photoelectric check station 23 during this checking operation is shown in FIG. 5, which will be described below. Ejection station 24 is partially shown in FIG. 3. Specifically, table 58 is shown in its inclined position and the lower portion of the ejection device 62 is seen attached to table 58. Also, the rear portion of third transfer mechanism 66 is shown lying immediately above and to the rear of plate 16. Ejection station 24 is shown in greater detail in FIG. 6. Stations 22, 23 and 24 are supported on a framework 76 which can be of any suitable design.

Figure 4:
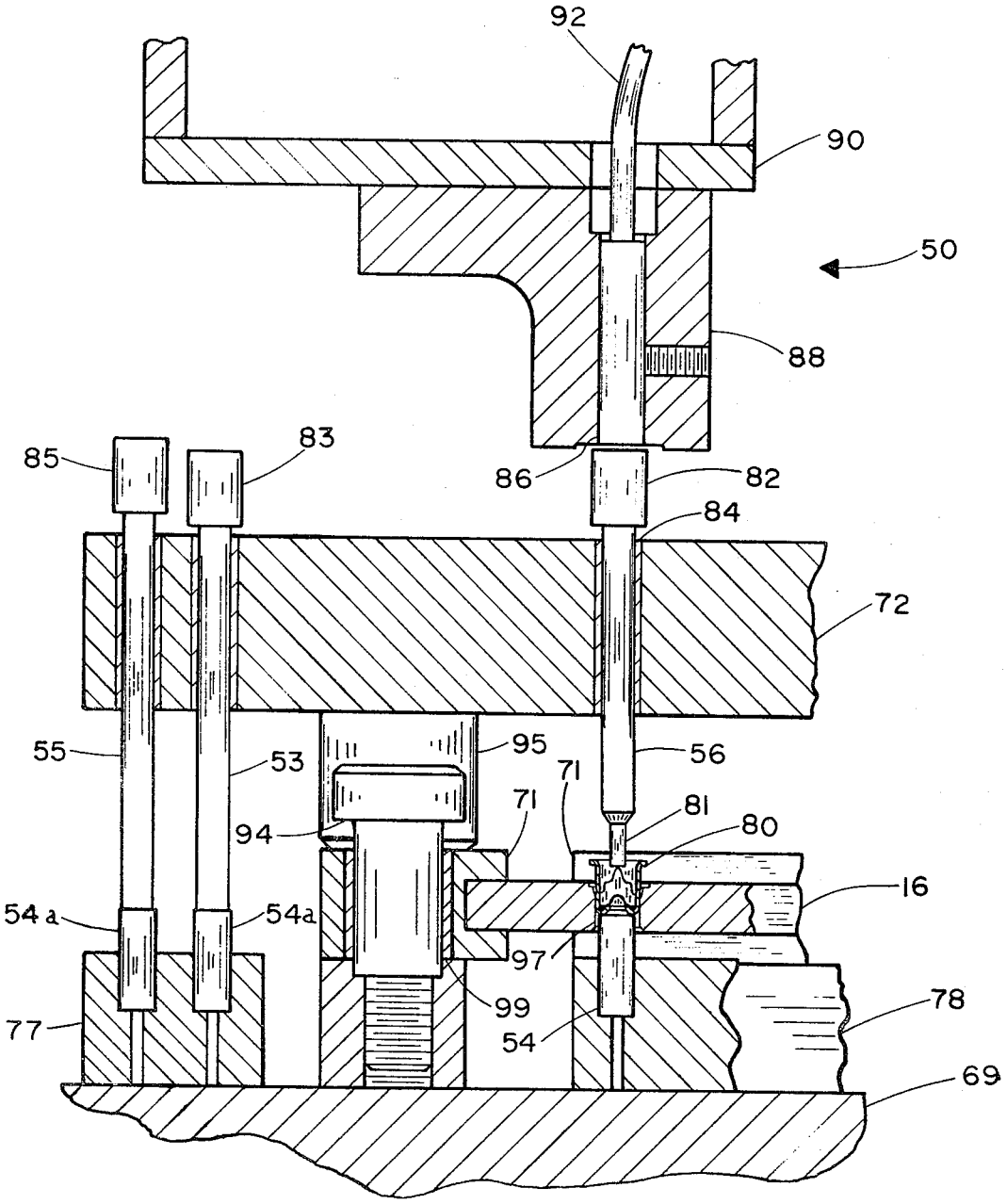
FIG. 4 is an enlarged view of the gauging station of FIG. 1.

FIG. 4 is a cross-section through the region indicated in FIG. 3 to show the gauging station 22 in greater detail. FIG. 4 shows the gauging station 22 in its operative position during the gauging operation. Specifically, plate 16 is in position held by side channels 70 and 71 and a battery cup 80 is being gauged for acceptability. Gauging station 22 comprises a bottom pin holder 78, a calibration pin holder 77, a support member 69, bottom gauge pins 54, top gauge pins 56, short top calibration pins 53, long top calibration pins 55, a top pin support member 72, a slide post 94, two side channels 70 and 71, and a sensor bar 50. Calibration pin holder 77 and bottom pin holder 78 are high tolerance parts which serve as reference plates and which are supported by and carefully and precisely attached to support member 69. Holders 77 and 78 serve to hold arrays of pins 54 which project up from plates 77 and 78 in alignment with the top pins 53, 55 and 56. Support member 69 is, in turn, attached to a lifting mechanism 74 so that pin holder 78 can be moved upwardly in order to cause the pins 54 in holder 78 to lift battery cups 80 partially from carrier plate 16 during the gauging process. Sensor bar 50 comprises a plurality of eddy current sensors 86, a sensor rail 88, a sensor rail support member 90 and a plurality of sensor leads 92. Sensors 86 measure the height of the heads 82, 83 and 85 of pins 53, 55 and 56 and pass this information as signals through sensor lead 92 to control unit 15. Sensors 86 are held by sensor rail 88 which is in turn attached to support member 90. Support member 90 can be moved laterally over heads 83, 85 and rows of heads 82 so that all battery cups 80 can be measured in sequence without moving carrier plate 16 during the gauging process, once carrier plate 16 is in position within station 22. Although only one top gauge pin 56, one short top calibration pin 53 and one long top calibration pin 55 and one bottom pin 54 are shown measuring one battery cup 80, there are actually several pins 53, 55 and 56, bottom pins 54 and battery cups 80 in a row, all being measured in rapid succession. Leads 92 are sequentially checked by control unit 15 so that a series of signals are received by control unit 15 indicating the heights of first the heads 83 and 85 of the calibration pins 53 and 55 to set tolerance limits and then the various heads 82 within gauging station 22. Slide post 94 serves to upwardly restrain side channels 70 which are spring mounted and which are held down by a hold down member 95 during the gauging process. Side channel 70 can be provided with a sleeve 99 to make them slide more easily on slide post 94, if desired. Similarly, top gauge pin 56 slides within a sleeve 84, the sleeve being mounted within top pin support member 72. It will be appreciated that sensor 86 is actually measuring the "stack height" of bottom gauge pin 54, battery cup 80 and top pin 56. For this reason, it is desirable to initially calibrate this stack height by a preliminary calibration procedure in which spacers of known dimension simulating optimum battery cups 80 are positioned within the openings 97 of carrier plate 16 and a gauging operation performed on those spacers. This calibration procedure will result in a determination of the stack heights for uniform simulated product of an acceptable height. The locations and measurement signals of the top pins producing those readings can be memorized and control unit 15 can be programed to automatically adjust the signal from the sensor 86 at that position and thus compensate for any variations in lengths of the various pins 56 so that at all locations the product can be measured independent of the gauge pin lengths.

FIG. 5 is an expanded cross-sectional view through the photoelectric check station 23 of FIG. 3. Check station 23 comprises upper and lower photoelectric portions 98 and 100. Either one can be a transmitter and the other one would be the receiver. Photoelectric portions 98 and 100 are connected by leads 198 and 101 to control unit 15. As carrier plate 16 passes between portions 98 and 100 battery cups 80 are brought between portions 98 and 100. If a light beam can be passed from one of the portions 98 and 100 to the other then a signal is generated through leads 99 and 101. No signal is passed when carrier plate 16 passes between portions 98 and 100 unless light can pass through openings 97. If battery cups 80 are acceptable they will have a foil 105 over their lower end which will prevent a light beam from passing between portions 98 and 100 when openings 97 are aligned with portions 98 and 100. If there is no battery cup 80 at that position or if foil 105 is absent, this light beam will pass between portions 98 and 100 to generate a signal indicating an unacceptable battery cup 80. Control unit 15 will memorize the location which produced this signal so that the unacceptable battery cup can be ejected at ejection station 24. The sensitivity of check station 23 is preferably such that even pin holes in foil 105 will allow sufficient light to pass between portions 98 and 100 to generate a signal sufficient to cause control unit 15 to memorize the location for later ejection of a battery at that location. Portions 98 and 100 are positioned within two fixed support blocks 93 which are in turn attached to framework 76 above and below the path which carrier plate 16 will traverse in moving from gauging station 22 to ejection station 24. The position of portions 98 and 100 within blocks 93 can be adjusted and then fixed by suitable fastening means such as set screws 102.

Figure 6:
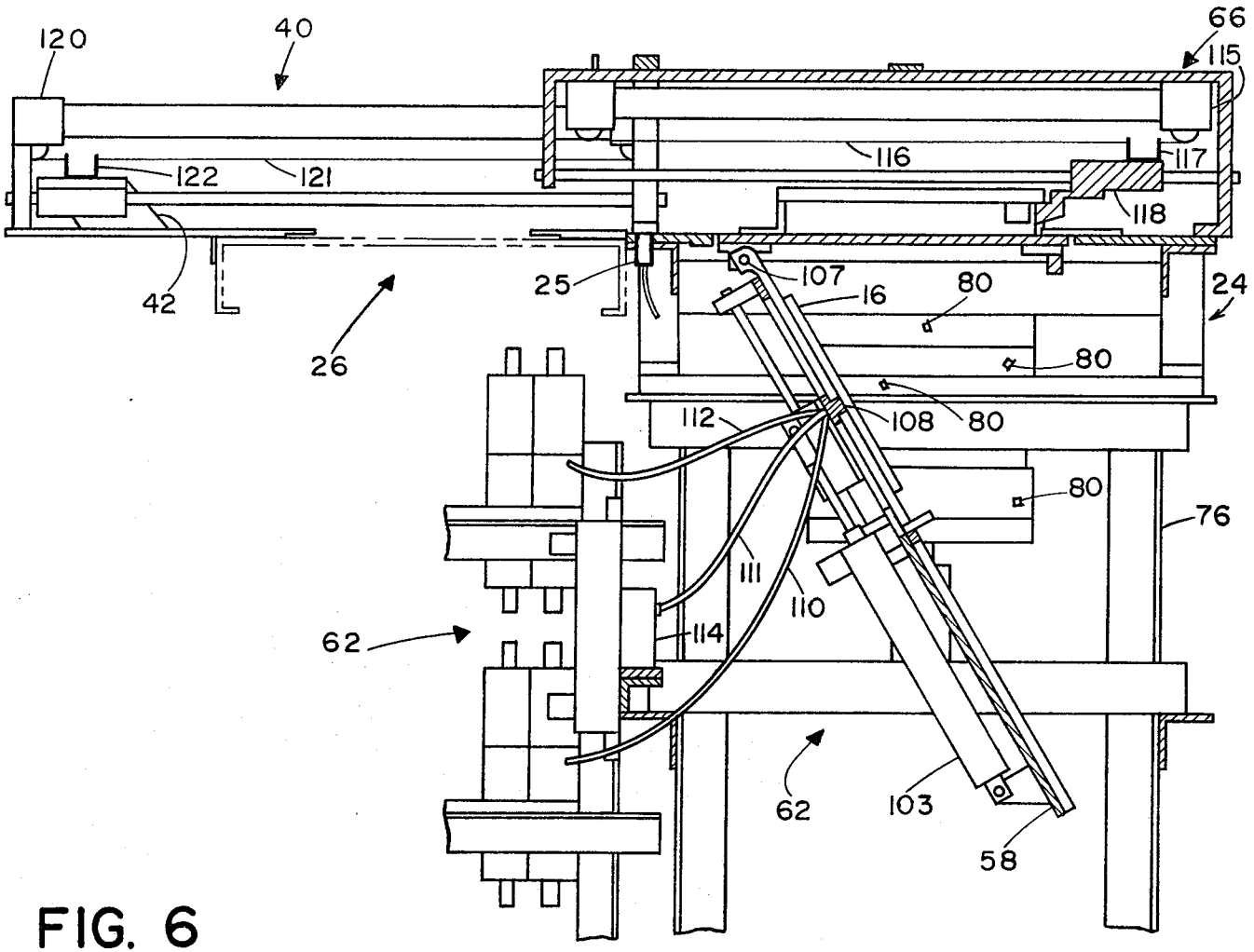
FIG. 6 is a vertical cross section taken along lines 6—6 of FIG. 1.

FIG. 6 is a vertical cross-sectional view taken along line 6—6 of FIG. 1 to show the structure and operation of ejection station 24. FIG. 6 also shows the operation of push mechanism 40 and third transfer mechanism 66. Ejection station 24 comprises a frame 58, an ejection device 62, pivot mechanism 60 (see FIG. 1), an activation switch 64 (see FIG. 1) and a third transfer mechanism 66. Frame 58 is attached to pivot mechanism 60 and is adapted to rotate downward so that battery cups 80 can be ejected from plate 16 at the memorized locations without falling back into plate 16. Ejection device 62 comprises a cylinder 103, an ejection nozzle bar 108, a plurality of pneumatic hoses 110, 111 and 112 and a plurality of pneumatic valves 114. Cylinder 103 moves nozzle bar 108 across the bottom of plate 16 in its inclined position and valves 114 are selectively activated in response to activation signals from control unit 15 so as to eject only its battery cups which are unacceptable. It will be recalled that the unacceptable battery cups are those for which the position was memorized in response to the signal indicative of unacceptability at either gauging station 22 or photoelectric check station 23. It will be understood that control unit is preferably a microprocessor unit capable of real-time calculations and instructions so that there is no need to wait for control unit 15 to calculate which battery cups are acceptable and which are unacceptable, but rather control unit 15 can determine this information during passage of carrier plate 16 into ejection station 24 and lowering of incline frame 58 to its inclined position. After the unacceptable battery cups 80 are ejected nozzle bar 108 is returned to its original position and incline frame 58 is rotated by pivot mechanism 60 back up to its original horizontal position and third transport mechanism 66 is activated to push carrier plate 16 into exit station 26. Third transport mechanism 66 includes a motor reel 115, cable 116, posts 117 and a pusher channel 118. Motor reel 115 can be selectively operated to move cable 116. Cable 116 is attached to posts 117 and posts 117 are, in turn, attached to pusher channel 118. Thus, when motor reel 115 is activated, pusher channel 118 is moved to the left in FIG. 6. Motor reel 115 is activated when incline frame 58 returns to its horizontal position following the ejection of unacceptable battery cups 80 so that pusher channel 118 pushes carrier plate 16 into exit station 26.

Push mechanism 40 is similar to third transport mechanism 66. Push mechanism 40 includes a motor reel 120, a cable 121, posts 122 and a pusher channel 42. Motor reel 120 is activated in response to activation of activator sensor 44 of receiving station 20 to push carrier plate 16 from receiving station 20 to gauging station 22 (see FIG. 1).

Figure 7:
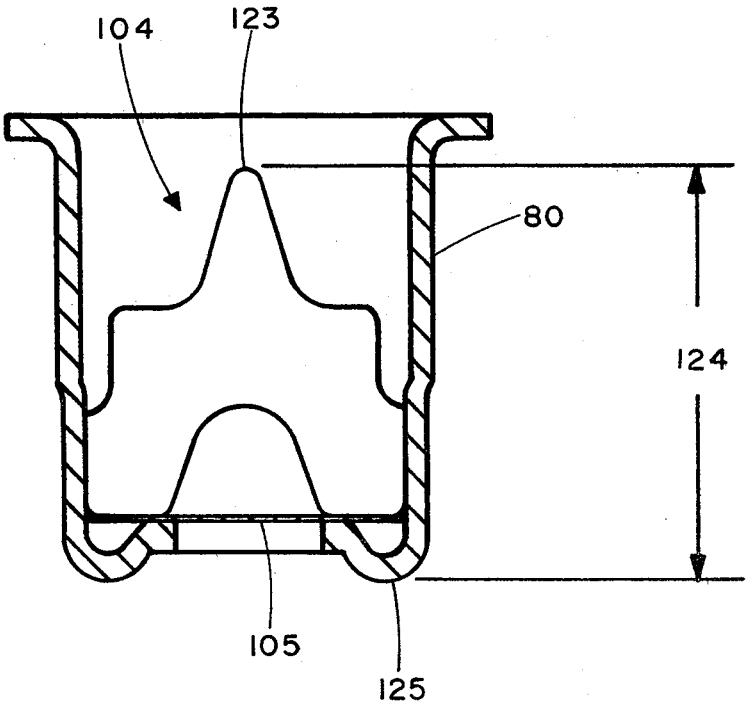
FIG. 7 is a cross-section through a typical battery cup which can be inspected by the system of FIG. 1.

FIG. 7 shows an expanded view of a battery cup 80 which is seen to comprise the battery cup 80 itself, an anvil 104 and a foil 105. The anvil serves to percussively ignite a percussion-sensative primer high explosive which will be subsequently added to the battery cup 80 during further processing of battery cup 80 following the operation of inspection system 14. In order for anvil 104 to serve its function properly it is necessary that the top 123 of anvil 104 be at a certain height 124 above the base 125 of battery cup 80. It is this height 124 that is gauged in gauging station 22. Referring to FIGS. 4 and 7, it will be seen that the lower tip 81 of top gauge pin 56 rests on top 123 of anvil 104 while the top of bottom gauge pin 54 rests against bottom 125 of battery cup 80 during the gauging operation. Lower tip 81 can be made to have a smaller diameter than the remainder of pin 56 in order to fit within cup 80 for this purpose.

Control unit 15 is a microprocessor unit with suitable input and output connections to the various components of inspection system 14, such as transport mechanisms 40, 52 and 66 and the various leads 92, 99 and 101. The operation of control unit 15 will not be described in detail since it is within the skill of the ordinary microprocessor programing engineer to develop a program suitable for analyzing the various signals produced by and fed to inspection system 14. With the increasing use of microprocessor technology in industry generally has come the ability to develop suitable programs for application to machine control such as control of inspection system 14.

With the above disclosure in mind, it will be appreciated that many variations can be made within the scope of the invention. For example, although an eddy current sensor is utilized to measure the gauge pin stack heights, it will be understood that other sensor mechanisms could also be used in place of eddy current sensors. Similarly, although a motor reel and cable system is used in the transport mechanism, other transport mechanisms could be substituted, if desired. Although the pin holder 78 is preferably raised and plate 16 is preferably lowered during gauging to lift cups 80 free of the plate 16, it will be understood that it is only raising of the pin holder 78 relative to the plate 16 that is essential. Although the apparatus shown in the drawings is designed to measure the anvil-to-base height of a battery cup for use in ammunition primers, other products could be measured by use of the apparatus and method disclosed. The method is particularly well-suited for large volumes of relatively small components where extremely rapid and automatic inspection is necessary.

It will, therefore, be appreciated that the invention is not limited to the particular preferred embodiment shown but extends to other equivalents as well.

What is claimed is:

1. A method of automatically removing products of an unacceptable height from an array of products in a production line, which comprises the steps of:

(a) supporting a quantity of said products in a product carrier in an array of rows and columns;
(b) moving said carrier to a gauging station;
(c) placing said array between a planar reference plate and an array of gauging members of known height;
(d) uniformly raising said planar reference plate, relative to said carrier plate and said gauging members, to a predetermined height position so as to cause said planar reference plate to support said product array and said product array in turn to support said array of gauging members;
(e) measuring the height of each gauging member in said array of supported gauging members;
(f) generating a first rejection signal corresponding to each gauge member whose height is not within a predetermined range;
(g) storing said first rejection signals;
(h) lowering said planar reference plate, relative to said carrier plate and said gauging members, so that said product array is again supported by said carrier plate;
(i) moving said carrier plate to a rejection station;
(j) selectively activating a product removal device in response to said first rejection signals so as to automatically remove from said carrier plate only those products corresponding to gauging members which had an unacceptable height during said measuring; and
(k) returning said carrier plate to said production line.

2. The method of claim 1, wherein said measuring comprises passing at least one eddy current sensor along said array of product-supported gauging members to generate a measurement signal corresponding to the heights of said gauging members.

3. The method of claim 2 wherein said generation of said first rejection signal comprises the substeps of:

(a) producing an eddy current calibration signal corresponding to a lower height limit;
(b) producing an eddy current calibration signal corresponding to an upper height limit; and
(c) generating an error indication only when said eddy current measurement signal is not between said two eddy current calibration signals.

4. The method of claim 1 wherein said selective activation of said removal device further comprises:

(a) moving said carrier plate from a horizontal initial position to a partially vertical position;
(b) removing unacceptable products from said carrier plate in said partially vertical position; and
(c) returning said carrier plate to said horizontal position.

5. The method of claim 1 further comprising the steps of:

(a) moving said carrier plate to an inspection station following said selective product removal;
(b) inspecting for presence of product in each position of said carrier plate;
(c) generating a set of inspection signals indicative of presence and absence of product in said positions;
(d) comparing said set of inspection signals with said stored first rejection signals; and
(e) generating an error indication if said set of inspection signals indicate presence of a product which said stored first rejection signals indicate is unacceptable.

6. The method of claim 5 which further comprises the step of:

preventing said carrier plate from proceeding along said production line if said error signal is generated.

7. The method of claim 1 further comprising the steps of:

(a) moving said carrier plate through an inspection station after said height measuring but before activation of the product removal device;
(b) checking at said inspection station for presence or absence of a certain component of said product at each product location in said product array;
(c) generating a second rejection signal corresponding to each array location where said component is not sensed;
(d) storing said second rejection signals;
(e) activating said product removal device in response to said second rejection signals so as to also automatically remove from said carrier plate those products not having the component checked for.

8. The method of claim 7 wherein said checking includes the step of:

attempting to pass a photoelectric beam through each of said products in said product array in such a way that said beam must pass through the location where said component would be found in acceptable products.

9. The method of claim 8 wherein said product is an ammunition primer and said component is a foil.

10. The method of claim 1 wherein said product is a percussive ammunition primer having an anvil and said supported gauging members are supported by said anvil during said measuring step.

* * * * *